US006328397B1

(12) United States Patent
Shimizu et al.

(10) Patent No.: US 6,328,397 B1
(45) Date of Patent: Dec. 11, 2001

(54) DRIVE VOLTAGE ADJUSTING METHOD FOR AN ON-DEMAND MULTI-NOZZLE INK JET HEAD

(75) Inventors: Kazuo Shimizu; Takuji Torii; Nobuhiro Noto; Yoshitaka Akiyama; Masatoshi Sakata; Shigenori Suematsu, all of Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/390,669

(22) Filed: Sep. 7, 1999

(30) Foreign Application Priority Data

Sep. 7, 1998 (JP) ..... 10-252448
Dec. 4, 1998 (JP) ..... 10-344957

(51) Int. Cl.[7] ..... B41J 29/38
(52) U.S. Cl. ..... 347/10
(58) Field of Search ..... 347/10, 11, 9, 347/19, 12, 88, 55

(56) References Cited

U.S. PATENT DOCUMENTS 5,621,447 * 4/1997 Takizawa et al. ..... 347/88
5,757,392 * 5/1998 Zhang ..... 347/14
6,102,512 * 8/2000 Torii et al. ..... 347/10
6,123,415 * 9/2000 Nagato et al. ..... 347/55

FOREIGN PATENT DOCUMENTS 10-119260 5/1998 (JP) .

* cited by examiner

*Primary Examiner*—N. Le
*Assistant Examiner*—K. Feggins
(74) *Attorney, Agent, or Firm*—McGuireWoods LLP

(57) ABSTRACT

To eliminate influence of cross-talk in an on-demand multi-nozzle ink jet head, drive pulses to be applied to piezoelectric elements for driving nozzles aligned in a row are individually adjusted so that the nozzles eject ink droplets at the same speed when the nozzles are driven simultaneously. To the piezoelectric elements which are deactuated during printing, a dummy drive pulse having a voltage level in a range from 50 to 75% of a minimum voltage for ejecting an ink droplet is applied, whereby the ejection speed achieved when individual nozzles are driven approaches the ejection speed achieved when all nozzles are driven simultaneously. As such, the print quality is improved.

20 Claims, 5 Drawing Sheets

DRIVE VOLTAGE ADJUSTING METHOD FOR AN ON-DEMAND MULTI-NOZZLE INK JET HEAD

BACKGROUND OF THE INVENTION

1. Field of the Invention

The present invention relates to a drive voltage adjusting method for an office-use or industrial-use ink jet printer with piezoelectric elements for ejecting ink on demand.

2. Description of the Related Art

There are thermal and piezoelectric type on-demand ink jet heads. Thermal type ink jet heads use heaters to boil a portion of ink filling the head, to generate a bubble. Ink is ejected by force of the expanding bubble. Piezoelectric type ink jet heads include a piezoelectric element that deforms a portion of an ink chamber wall, in order to apply pressure to ink in the chamber and eject an ink droplet.

Thermal type heads are advantageous because they can be formed using lithography to a fine nozzle pitch of 100 $\mu$m or less. However, thermal type heads can only be driven at an ejection frequency of about 10 to 12 kHz during consecutive ejection. Also, only ink with a boiling point of about 100° C. can be used as the ink to be ejected, which hinders broad use of thermal type heads in industry. In addition, thermal type heads uses a thin-film resistor with a protective layer deposited thereon to generate heat. Generally, because the thin-film resistor and/or the protective layer is corroded before ejecting one hundred millions dots, replacement of the head needs to be performed at a short interval.

With regard to piezoelectric type heads, piezoeleotric elements deform only in small amounts, so the diaphragm in the ink chamber must have a large surface area to produce sufficient deformation for ink ejection. As a result, the nozzle pitch of piezoelectric type heads can not be formed smaller than about 140 $\mu$m at the present technology. However, piezoelectric type heads are well suited for high speed printing. That is, the drive frequency depends on the shape of the piezoelectric elements, so piezoelectric elements can be driven at a frequency of 20 kHz or more. Also. piezoelectric type heads are well adapted for industrial use, because in contrast to thermal type heads, they can be used to eject any type of ink and service life is much longer than that of the thermal type.

In a multi-nozzle ink jet printer, a head having a plurality of nozzles is mounted on a carriage, and the carriage is scanned in a horizontal direction across a recording sheet. The head is driven to print while the carriage is scanned horizontally across the recording sheet. Next, the recording sheet is transported in its lengthwise direction, that is, in a direction perpendicular to the horizontal direction. Then, the carriage is again scanned horizontally across the recording sheet. This cycle is repeated until images are printed across the entire recording sheet.

When all nozzles in the nozzle row are driven simultaneously and consecutively while the carriage is scanned across the recording sheet, then the resultant image will appear as a thick strip following the direction of the carriage scan direction. When the all nozzles in the nozzle row are driven simultaneously, but only intermittently while the carriage is scanned across the recording sheet, the resultant images appear as thin lines extending perpendicular to the direction of the carriage scan direction.

Multi-nozzle heads suffer from a problem called cross-talk. Cross-talk occurs when all nozzles of a nozzle row are fired simultaneously. When all nozzles are fired simultaneously, influence from adjacent nozzles changes the ejection speed, usually by reducing the ejection speed compared to when the nozzles are fired individually.

Because cross-talk changes the ejection speed of ink droplets, the position where the ink droplets impinge on the recording sheet can also vary. This can reduce the quality of printed images. The adverse effects of cross-talk are particularly noticeable when all nozzles in a nozzle row are intermittently driven simultaneously. FIG. 6 shows a line printed by driving all nozzles in a row simultaneously once. As can be seen, the resultant line is curved, rather than straight.

It can also be seen in FIG. 6 that the nozzles in the center of the row are more greatly affected by cross-talk. Ink droplets ejected from the nozzles of the center of the row impinge on the recording sheet at positions downward from positions where ink droplets impinge from nozzles in the end of the nozzle row. This is because nozzles near the center of the row are more greatly influenced by cross-talk so that ejection speed of droplets from nozzles in the center of the row is more greatly reduced. In contrast, nozzles near the end of the row are relatively uninfluenced by cross-talk, so that ink droplets ejected from the end nozzles have relatively small reduction in the ejection speed. Because the different nozzles are affected differently, the ink droplets impinge at positions shifted from each other on the recording medium. As a result, a printed line that should be straight is actually curved.

The reason for this is that the drive conditions of the nozzles are individually determined to achieve a desired ejection speed and influence of cross-talk is not taken into account when all the nozzles are driven simultaneously.

Japanese Laid-Open Patent Publication No. HET-10-119260 discloses a configuration with a compensation piezoelectric member for reducing cross-talk. However, this configuration requires provision of the compensation piezoelectric member. Also, in order to eject ink properly, it is necessary to drive the compensation piezoelectric member by applying compensation drive voltages in complete or substantial synchronization with operations for reducing and increasing pressure in the ink chambers. This requires addition of control circuitry for the compensation piezoelectric member. As a result, cost for producing the configuration increases.

SUMMARY OF THE INVENTION

It is a object of the present invention to provide an ink jet head that can be produced at a relatively low cost by using only presently available drive control circuitry, and further that produces images with good quality without influence from cross-talk.

To achieve the above and other objects, the present invention provides a drive voltage adjusting method for an on-demand multi-nozzle ink jet head including a plurality of ink chambers filling ink therein, the ink chambers being defined by a nozzle plate formed with a plurality of nozzles in one-to-one correspondence with the plurality of ink chambers, and a plurality of piezoelectric elements provided in one-to-one correspondence with the plurality of ink chambers, the piezoelectric elements belong deformed when a drive pulse is applied thereto, thereby varying pressure in a corresponding ink chamber and ejecting an ink droplet from a corresponding nozzle, the method including the steps of: (a) applying a drive pulse to all piezoelectric elements selected from the plurality of piezoelectric elements to eject ink droplets from corresponding nozzles; and (b) individually adjusting the drive pulse applied to the selected piezoeleotric elements so that the corresponding nozzles eject ink droplets at the same speed when the corresponding nozzles ore driven simultaneously.

As described, conditions for driving nozzles are determined by placing priority on driving all nozzles of a row simultaneously, rather than on driving nozzles individually which is the conventional method for determining drive conditions. According to the present invention, at least one of the drive voltage or the pulse width for driving nozzles is adjusted given priority to print results obtained when all nozzles in a row are driven simultaneously.

According to the present invention, an ink jet head that is not influenced by cross-talk can be produced at a relatively low cost without providing any special drive control circuitry. Therefore, manufacturing costs can be suppressed and also images can be produced with enhanced quality.

A dummy drive voltage may be applied to piezoelectric elements which are not driven during printing. The dummy drive voltage should have a voltage level in a range from 50 to 75% of a minimum voltage for ejecting an ink droplet.

The ink jet head is driven by the drive pulse that achieves a uniform ejection speed for all nozzles when all nozzles are driven simultaneously. When less than all nozzles of the ink jet head are driven in this manner, that is when single nozzles are driven individually, or when a few nozzles are driven simultaneously, the difference between ejection speed generated when all nozzles are fired and ejection speed when individual nozzles are fired simultaneously can be reduced by applying an appropriate dummy voltage to those nozzles that are not to have droplets ejected therefrom.

BRIEF DESCRIPTION OF THE DRAWINGS

The particular features and advantages of the invention as well as other objects will become more apparent from the following description taken in connection with the accompanying drawings, in which.

DETAILED DESCRIPTION OF THE PREFERRED EMBODIMENT

Figure 1:
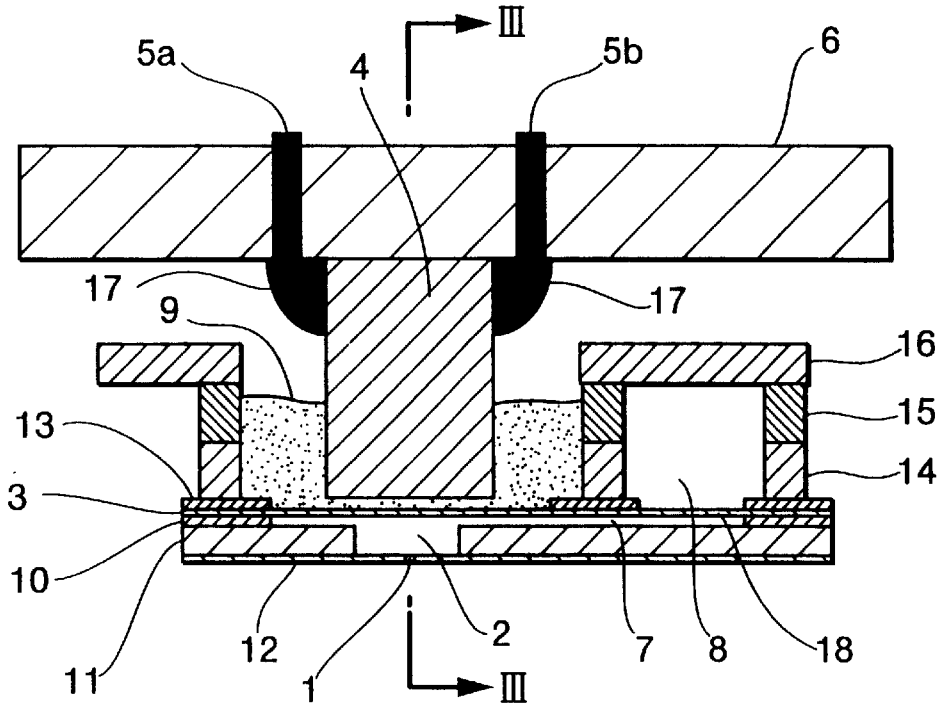
FIG. 1 is a cross-sectional view showing an ink jet head according to an embodiment of the present invention.
Figure 3:
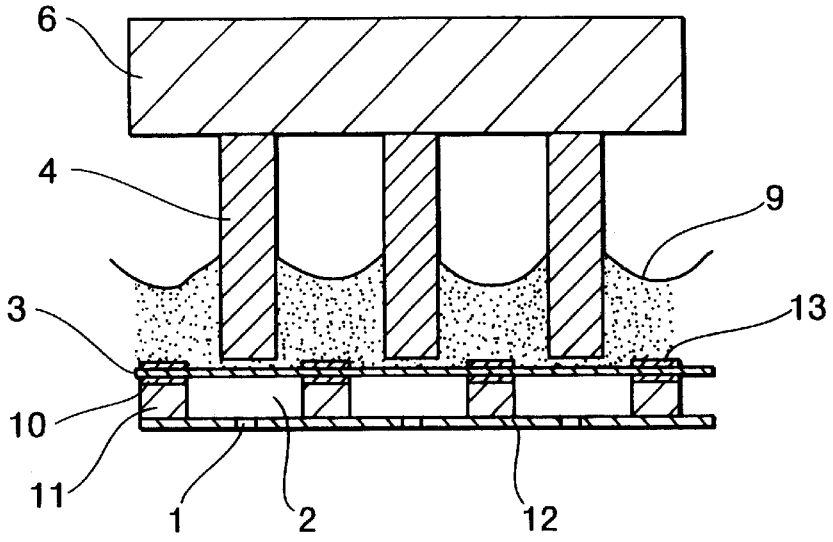
FIG. 3 is a cross-sectional view taken along a line III—III of FIG. 1.

FIGS. 1 and 3 show a nozzle portion of a multi-nozzle ink jet head according to a preferred embodiment of the present invention. FIG. 3 is a cross-sectional view taken along line III—III of FIG. 1. The head ejects ink according to a print signal to record images. The print signal is applied to signal input terminals 5*a*, 5*b*.

As shown in FIG. 3, a plurality of piezoelectric elements 4 are aligned in a one-to-one correspondence with a corresponding plurality of ink chambers 2. As best seen in FIG. 1, one end of each piezoelectric element 4 is secured to a head substrate 6, which is made from an insulating material, such as ceramics or polyimide. The other end of each piezoelectric element 4 is attached to a diaphragm 3 by a resilient material 9, such as silicon adhesive. The piezoelectric elements 4 are connected to external control wires (not shown) by the signal input terminals 5*a*, 5*b* and conductive adhesive 17.

The ink chambers 2 are defined by a chamber plate 11 and a nozzle plate 12, which is formed with nozzles 1. A support plate 13 is provided for reinforcing the diaphragm 3. A restricter 7 for controlling flow of ink into the ink chambers 2 is defined by a restricter plate 10. The restricter 7 connects the ink chambers 2 with a common ink supply channel 8, which is defined by common ink supply channel plates 14, 15 and a common ink supply channel cover 16. A filter 18 is disposed between the restricter 7 and the channel 8. The diaphragm 3, the restricter plate 10, the chamber plate 11, and the support plate 13 are formed from stainless steel. The nozzle plate 12 is formed from nickel.

Ink is supplied from the common ink supply channel 8 into the ink chambers 2 through individual restricters 7 defined by the restricter plate 10 and the diaphragm 3.

A print signal in the form of a drive voltage is applied through the input terminals 5*a*, 5*b* to each piezoelectric element 4, to selectively deform the piezoelectric elements 4. Each piezoelectric element 4 used in this embodiment contracts when applied with a drive voltage when application of the drive voltage is stopped, the piezoelectric element 4 reverts to its initial length.

To eject an ink droplet, the drive voltage is applied to the piezoelectric element 4, so that the piezoeleotric element 4 contracts in a direction away from the ink chamber 2. This deforms the diaphragm 3 to increase the volume of the ink chamber 2, thereby introducing ink into the ink chamber 2. When application of the drive voltage is stopped, the piezoelectric element 4 reverts to the elongated condition, so that the pressure in the ink chamber 2 increases and thus ink droplet is ejected.

Figure 2:
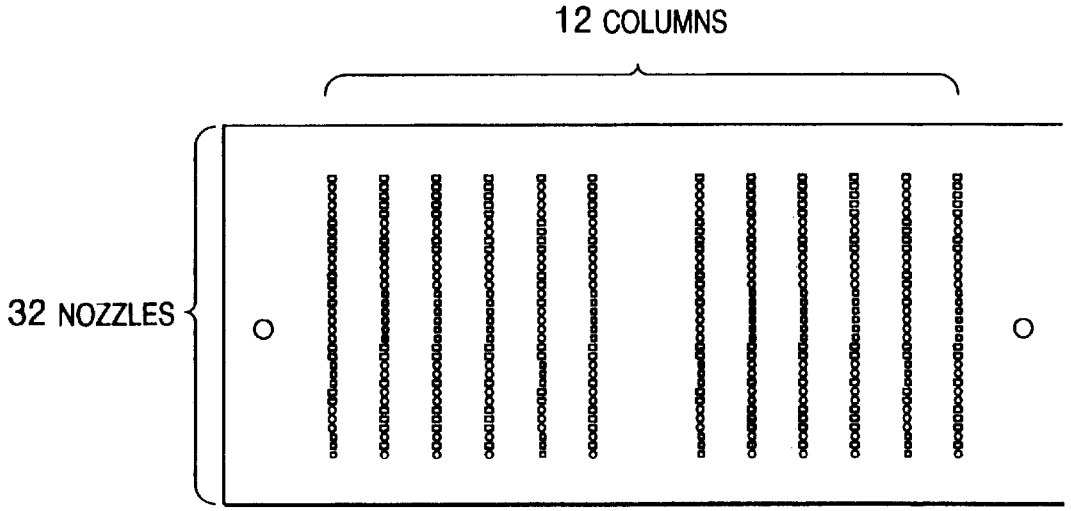
FIG. 2 is a plan view showing distribution of nozzles in the nozzle plate of the ink jet head of FIG. 1.

FIG. 2 shows nozzle rows of an ink jet head according to the present invention. As shown in FIG. 2, the ink jet head is formed with 12 nozzle rows, with 32 nozzles aligned in each row for a total of 384 nozzles.

Normally, when all nozzles in a row are driven simultaneously, the speed of ejected ink froplets is reduced by cross-talk to slower than when nozzles are driven individually. Conventionally, the drive voltage and/or drive pulse width for each nozzle is determined by driving each nozzle individually. The drive voltage and/or drive pulse width that drives a nozzle to eject an ink froplet at a particular speed is selected as the drive voltage or drive pulse width on a nozzle basis.

Figure 4:
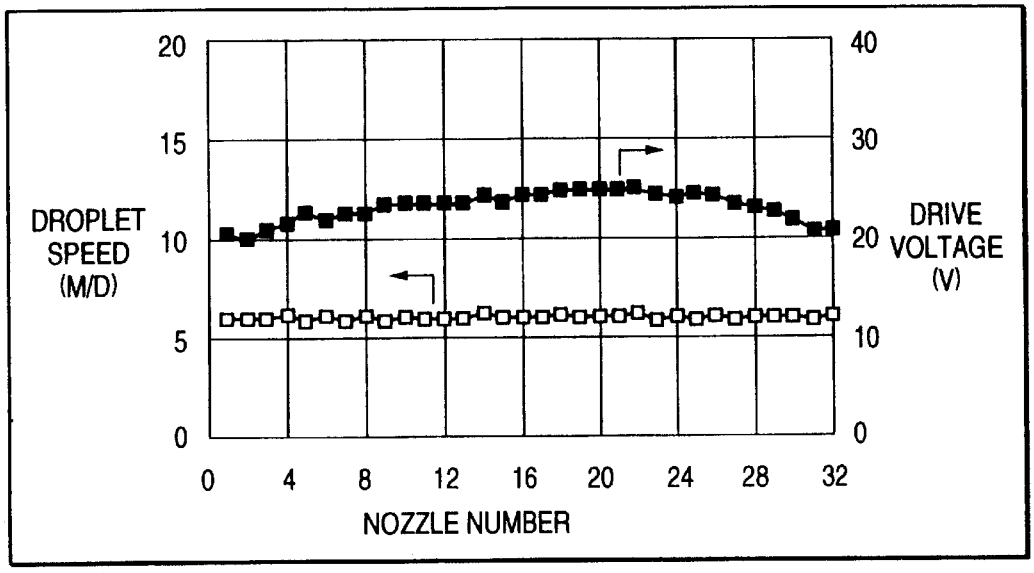
FIG. 4 is a graph showing different drive voltages applied to different nozzles of a nozzle row to achieve a uniform ejection speed for all nozzles when all nozzles are driven simultaneously.

In contrast, according to the present invention, the drive voltage and/or drive pulse width for each nozzle is determined while driving all nozzles simultaneously. As shown in FIG. 4, the drive voltage is set differently for each nozzle so that all nozzles eject ink droplets at the same desired speed when driven simultaneously. Although not shown in the drawings, the drive pulse width could be selected in this manner to achieve the same effect. The drive voltage and/or the drive pulse width will be referred to collectively as "drive conditions", hereinafter. According to the present invention, the drive conditions are determined so that all nozzles eject ink droplets at the same speed when all nozzles are driven simultaneously.

One method for determining the drive conditions of the nozzles is to use a microscope and a stroboscope to observe ink droplets ejected when all nozzles of a print head are driven simultaneously. While observing the ink droplets, either the drive voltage or the drive pulse width, or both is adjusted for each nozzle until ink droplets from all nozzles are ejected at the same desired speed.

Another method of determining the drive conditions of the nozzles is to drive all nozzles simultaneously once to print a straight line on a recording sheet. Then, the amount of shift between the actual impinging position and a desired impinging position is measured for each droplet. Based on the amount of shift, either the drive voltage or the pulse width, or both is adjusted for corresponding nozzles.

Still another method of determining the drive conditions is to first drive each nozzle individually, and determine the drive voltage and the pulse width that is required for each nozzle to elect a droplet at a predetermined ejection speed. Then, either the drive voltage or the pulse width, or both are changed, that is, increased or decreased, by an amount corresponding to changes in ejection speed caused by cross-talk when all nozzles are driven simultaneously.

In this way, drive conditions for individual nozzles are determined according to the present invention by assuming that all nozzles will be fired simultaneously, whether consecutively to print large section of a printing sheet, or intermittently to print vertical straight lines. This enables to take the effects of cross-talk on predetermined nozzles, particularly nozzles near the center of a nozzle row, into account when determining the drive conditions. Therefore, quality Of printing performed when all nozzles in a row are simultaneously driven, that is, whether consecutively or intermittently, is superior to the quality of conventional printing as influenced by cross-talk. It should be noted that when nozzles are driven individually using drive conditions determined based on simultaneous drive, differences in ejection speed may result between individual nozzles. However, individual nozzles eject only extremely small amounts of ink, so any difference in ejection speed will not produce a visible influence in the resultant print quality, even if ink droplets from individual nozzles impinge at positions slightly shifted from a desired impingement position.

Next, determination of the drive conditions in the case of time division drive will be described. During time division drive, each row of nozzles is divided into nozzle groups, and the groups are driven to eject ink at shifted timing. For convenience sake, the following description will be provided for when nozzles in each nozzle row is divided into two groups of odd-numbered and even-numbered nozzles. This drive method is called the odd-even time division drive method. However, It should be noted that this should not be considered a limitation of the present invention. Nozzles in each nozzle row can be divided in a different manner.

In this example, each nozzle row includes 32 nozzles as shown in FIG. 2. The nozzles are divided into two groups of 16 nozzles of each. The even-numbered nozzles are driven first, and the odd-numbered nozzles are driven at a half cycle after the even-numbered nozzles are driven, wherein the drive period is determined as the reciprocal number of the drive frequency.

It is conventional wisdom that when nozzles are driven at time division, ejections by previously fired nozzles do not adversary affect ejections from subsequently fired nozzles. However, in actuality, when nozzles are fired during the same cycle, the previously fired nozzles influence the subsequently fired nozzles and can cause defective ejections, reduced ejection speed, and other related problems.

The drive conditions for time division drive according to the present invention are determined by driving all nozzles of each group simultaneously and adjusting the drive voltage, the drive pulse width, or both required for individual nozzles to eject ink droplets at the same predetermined speed while all nozzles of each group are driven simultaneously. The same methods described above, such as stroboscopic observation, can be used for determining the drive conditions that enable all nozzles to eject droplets at the same ejection speed when all nozzles, that is, even-numbered nozzles and odd-numbered nozzles, are fired during the same cycle.

Good effects are achieved using the above-described drive method for driving all odd- and even-numbered nozzles simultaneously. However, droplets are sometimes ejected at speeds that differ depending on whether selected nozzles are simultaneously driven or all nozzles are driven simultaneously. According to the present invention, the following measures can be taken to avoid this problem.

When determining the following measures, it was assumed that the speed of ejected droplets is different when adjacent nozzles or every other nozzle are driven simultaneously from when selected nozzles are driven simultaneously. It was also assumed that this difference is caused by vibration that propagates through the ink, the piezoelectric element, and the diaphragm when more than one nozzle are driven simultaneously, but that is not present when nozzles are driven individually. The present inventors thought that perhaps by applying a certain amount of voltage to nozzles that do not eject droplets, the resultant oscillation of the piezoelectric element and the meniscus could be used to reduce the difference in ejection speeds achieved when driving individual nozzles separately and all nozzles simultaneously.

It was determined that the difference between ejection speeds achieved by simultaneous and separate drive of nozzles can be reduced by driving nozzles that are not to eject droplets, that is, nozzles that have no print duty, at a voltage of 50–75% of the minimum voltage required for ejection of droplets. Additionally, the nozzles with no print duty are driven at the maximum drive frequency of the device, for example, the frequency of the printing device when all nozzles of the print head are driven simultaneously and consecutively. On the other hand, nozzles that eject droplets are driven using drive conditions determined as described above by adjusting drive conditions when all nozzles are fired simultaneously.

Next, a description will be provided for a method of determining an actual drive voltage. First, the minimum ejection voltage will be described. When voltage applied to a nozzle is incrementally increased, then the nozzle will start ejecting ink once a particular voltage is reached. This is considered the minimum ejection voltage. In this example, it will be assumed that the minimum ejection voltage for a particular nozzle is about 20V. Only the particular nozzle was driven to eject an ink droplet by applying the voltage determined as described above, that is, to achieve a uniform ejection speed when all nozzles are driven simultaneously The remaining nozzles, that is, the remaining 31 of the total 32 nozzles, were driven using what will be referred to as dummy drive hereinafter. During dummy drive, a voltage that does not induce ejection is applied at the maximum drive frequency of the printer. To determine the optimum dummy drive voltage, first, 25% of the minimum ejection voltage, that is, 5V in the present example, was applied to the non-ejecting nozzles using dummy drive. Then, the dummy drive voltage was changed from 25% to 50%, and than to 75% of the minimum ejection voltage. When the dummy drive voltage was increased to greater the a 75% of the minimum ejection voltage, it was observed that nozzles driven in this manner leaked ink, ejected ink, or otherwise adversely affected print quality.

Figure 5:
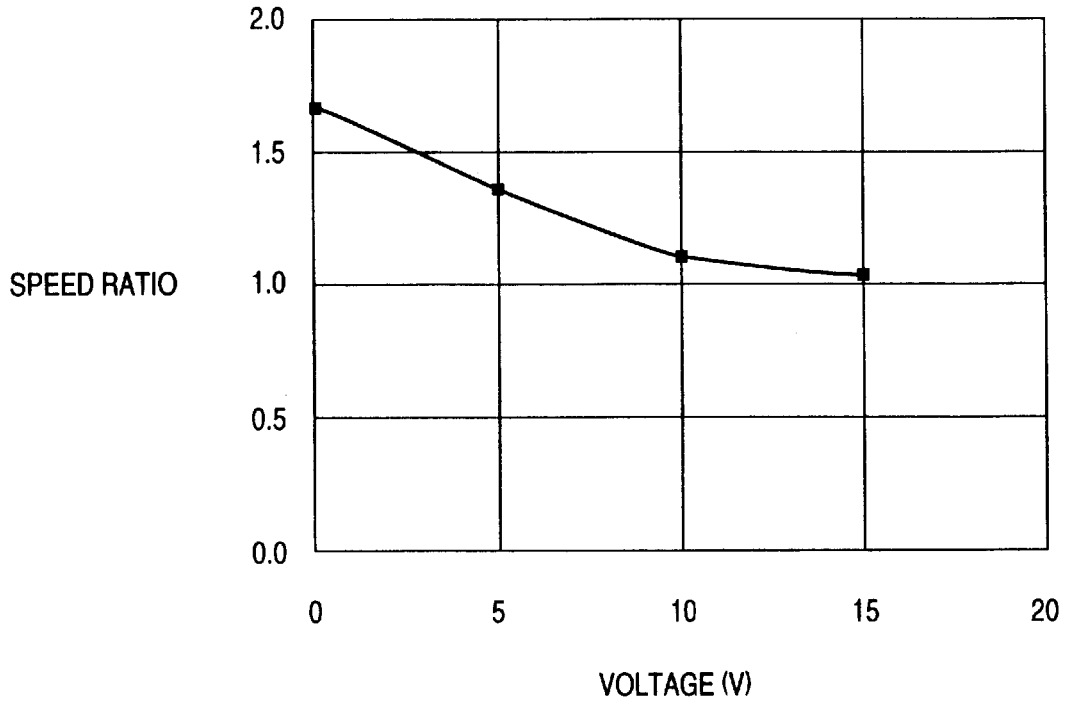
FIG. 5 is a graph showing a relationship between a dummy drive voltage and speed of ejected droplet according to the present invention.
Figure 6:
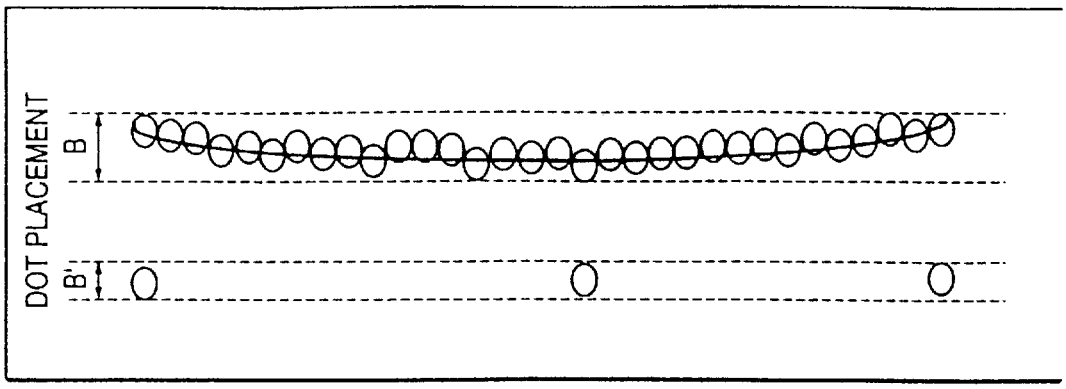
FIG.6 PRIOR ART
FIG. 6 is a schematic view showing print results obtained by driving all nozzles of a print head unit using a conventional drive method.

FIG. 5 shows the results of these tests for determining the optimum dummy drive voltage. The axis of abscissas indicates the applied dummy voltage and the axis of ordinates represents the ratio of ejection speed when a particular nozzle is fired to when all nozzles are fired. As can be seen in FIG. 5, when the dummy voltage is low, between 0 and 25%, ejection speed achieved when selected nozzles are fired simultaneously is much higher than when all nozzles are fired simultaneously. The influence of cross-talk remains even if the non-ejected nozzles are dummy driven. Therefore, a head drive environment that is the same as when all nozzles are driven simultaneously can not be properly maintained.

On the other hand, when the dummy drive voltage is increased to 50% or 75% of the minimum ejection voltage, the ejection speed achieved when individual nozzles are driven simultaneously approaches the ejection speed achieved when all nozzles are driven simultaneously. It was found that when the dummy drive voltage was increased too greatly, ink accumulated on the nozzle plate, erroneously ejections occur, and there was a possibility that a nozzle that was dummy driven would not subsequently eject a droplet when later needed. As can be aeon from FIG. 5, the optimum dummy drive voltage is between 50 and 75% of the minimum ejection voltage.

Figure 7:
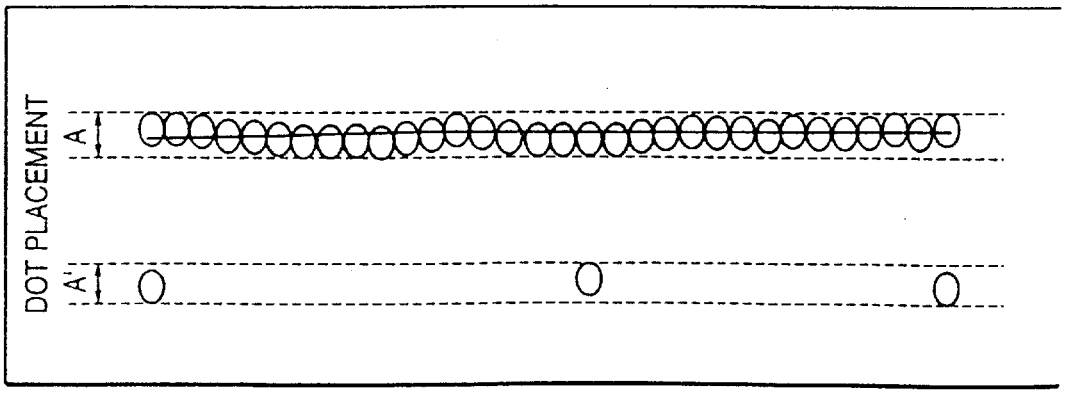
FIG. 7 is a schematic view showing print results obtained by driving all nozzles of a print head unit using a drive method according to the present invention.

A line can also be printed as shown in FIG. 7 when simultaneously driving all nozzles in a nozzle row once using drive conditions determined in this manner. As can be seen, all of the dots resulting from ejected ink droplets are printed in a straight line. Undesirable shift in impingement position was reduced even when one or a few nozzles were fired.

Figure 8:
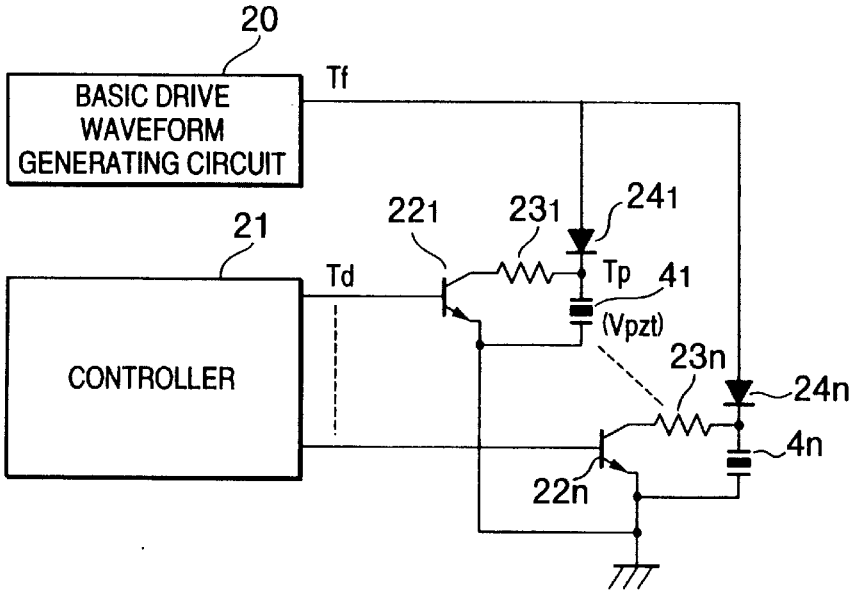
FIG. 8 is a circuit diagram for driving nozzles of a print head.
Figure 9:
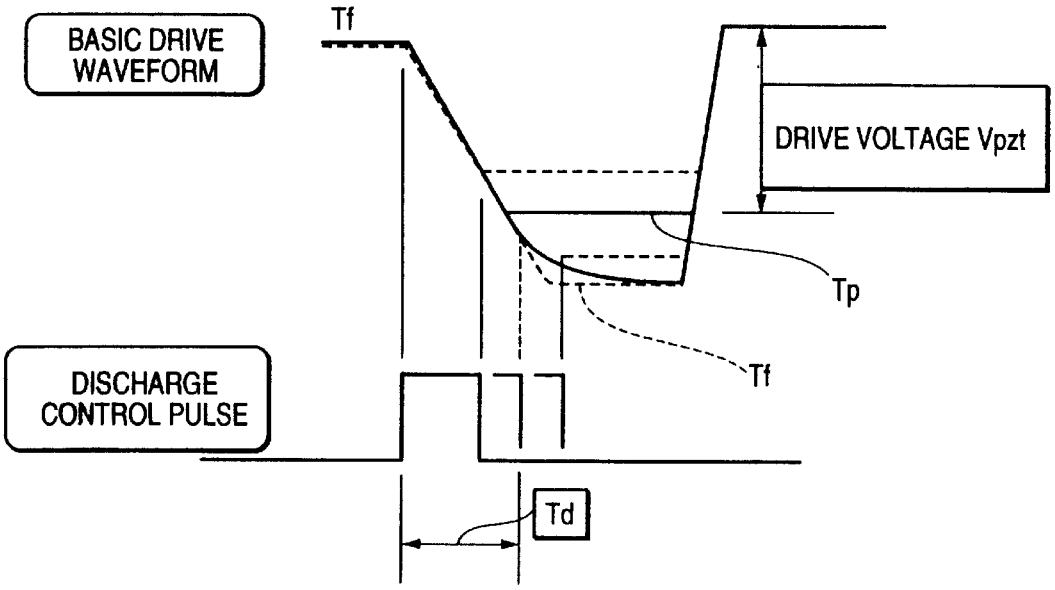
FIG. 9 is a waveform diagram for describing the operation of the circuit shown in FIG. 8.

FIG. 8 shows an arrangement of a control circuit for changing a drive voltage to be applied to a piezoelectric element. FIG. 9 illustrates the relationship between the drive voltage and the control pulse applied to the control circuit shown in FIG. 8. As shown in FIG. 8, the control circuit includes a basic drive waveform generating circuit 20 and a controller 21. Connected to the output of the controller 21 are a plurality or transistors $\mathbf{22}_1$ through $\mathbf{22}_n$ provided in one-to-one correspondence with the plurality of piezoelectric elements $\mathbf{4}_1$ through $\mathbf{4}_n$. The piezoelectric element $\mathbf{4}_1$ is connected across the collector and the emitter of the corresponding transistor $\mathbf{22}_1$. The remaining piezoelectric elements $\mathbf{4}_2$ through $\mathbf{4}_n$ are connected in the similar fashion. The basic drive waveform generating circuit 20 is connected to each of the piezoelectric elements $\mathbf{4}_1$ through $\mathbf{4}_n$ through corresponding diodes $\mathbf{24}_1$ through $\mathbf{24}_n$.

In operation, the basic drive waveform generating circuit 20 generates a fixed waveform Tf indicated by a dotted line in FIG. 9. The controller 21 outputs discharge control pulses Td to the transistors $\mathbf{22}_1$through $\mathbf{22}_n$. The pulse width of the discharge control pulses Td can be changed separately. In coincidence with the timing at which is the waveform Tf falls, the controller 21 generates the discharge control pulses Td to render the corresponding transistors conductive. During the discharge control pulses Td are high, the drive voltage $V_{PZT}$ applied to the piezoelectric element increases gradually, thereby deforming the piezoeleotric element. In coincidence with the falling edge of the discharge control pulse Td, the transistor $\mathbf{22}_1$ is rendered non-conductive and accordingly the voltage applied to the piezoelectric element is held constant (Tp), so that the deformed condition of the piezoelectric element is maintained. When the voltage level of the basic drive waveform Tf exceeds the voltage level Tp, the drive voltage $V_{PZT}$ applied to the piezoelectric element starts decreasing. At this timing, the piezoelectric elements starts reverting to the original state and ejects ink droplet from the corresponding nozzle.

As described, by adjusting the pulse width of the discharge control pulse, the drive voltage to be applied to the piezoelectric element can be changed.

While exemplary embodiments of this invention have been described in detail, those skilled in the art will recognize that there are many possible modifications and variations which may be made in these exemplary embodiments while yet retaining many of the novel features and advantages of the invention. Accordingly, all such modifications and variations are intended to be included within the scope of the appended claims.

What is claimed is:

1. A drive voltage adjusting method for an on-demand multi-nozzle ink jet head including a plurality of ink chambers filling ink therein, said plurality of ink chambers being defined by a nozzle plate formed with a plurality of nozzles in one-to-one correspondence with said plurality of ink chambers, and a plurality of piezoelectric elements provided in one-to-one correspondence with said plurality of ink chambers, each of said plurality of piezoelectric elements being deformed when a drive pulse is applied thereto, thereby varying pressure in a corresponding ink chamber and ejecting an ink droplet from a corresponding nozzle, the method comprising the steps of:

(a) applying a drive pulse to all piezoelectric elements selected from said plurality of piezoelectric elements to eject ink droplets from corresponding nozzles; and (b) individually adjusting the drive pulse applied to the selected piezoelectric elements so that said corresponding nozzles eject ink droplets at the same speed when said corresponding nozzles are driven simultaneously, the drive pulse being defined by a pulse width and a level.

2. The method according to claim 1, wherein said plurality of nozzles are arranged two-dimensionally and said corresponding nozzles are aligned in a row.

3. The method according to claim 2, wherein step (b) comprises adjusting the pulse width of the drive pulse.

4. The method according to claim 2, wherein step (b) comprises adjusting the level of the drive pulse.

5. The method according to claim 3, wherein step (b) further comprises adjusting the level of the drive pulse.

6. The method according to claim 1, further comprising the step of (c) photographing the ink droplets ejected from said corresponding nozzles after implementing step (a), wherein step (b) is implemented while referring to a photograph taken in step (c).

7. The method according to claim 6, wherein step (c) uses a microscope.

8. The method according to claim 6, wherein step (c) uses a stroboscope.

9. The method according to claim 1, wherein step (b) is implemented while referring to print results obtained upon implementing step (a).

10. A drive voltage adjusting method for an on-demand multi-nozzle ink jet head including a plurality of ink chambers filling ink therein, said plurality of ink chambers being defined by a nozzle plate formed with a plurality of nozzles in one-to-one correspondence with said plurality of ink chambers, said plurality of nozzles being arranged two-dimensionally wherein nozzles aligned in row are divided into a plurality of groups, the nozzles being driven in time division on a group basis, each of said plurality of piezoelectric elements being deformed when a drive pulse is applied thereto, thereby varying pressure in a corresponding ink chamber and ejecting an ink droplet from a corresponding nozzle, the method comprising the steps of:

(a) applying a drive pulse to piezoelectric elements belonging to the same group to eject ink droplets from corresponding nozzles; and (b) individually adjusting the drive pulse applied to the piezoelectric elements in the same group so that said corresponding nozzles eject ink droplets at the same speed when said corresponding nozzles are driven simultaneously, the drive pulse being defined by a pulse width and a level.

11. The method according to claim 10, further comprising the steps of (c) setting a dummy drive voltage applied to piezoelectric elements in the same group which are not driven during printing, the dummy drive voltage having a voltage level in a range from 50 to 75% of a minimum voltage for ejecting an ink droplet.

12. The method according to claim 10, wherein consecutively numbered piezoelectric elements aligned in a row are divided into an odd-numbered group and an even-numbered group, one of the odd-numbered group and the even-numbered group being driven during a first half period of a driving period determined by a driving frequency, and remaining one of the odd-numbered group and the even-numbered group being driven during a second half period of the same driving period.

13. The method according to claim 10, wherein step (b) comprises adjusting the pulse width of the drive pulse.

14. The method according to claim 13, wherein step (b) further comprises adjusting the level of the drive pulse.

15. The method according to claim 10, wherein step (b) comprises adjusting the level of the drive pulse.

16. The method according to claim 10, further comprising the step of (c) photographing the ink droplets ejected from said corresponding nozzles after implementing step (a), wherein step (b) is implemented while referring to a photograph taken in step (c).

17. The method according to claim 16, wherein step (c) uses a microscope.

18. The method according to claim 16, wherein step (c) uses a stroboscope.

19. The method according to claim 10, wherein step (b) is implemented while referring to print results obtained upon implementing step (a).

20. A drive voltage adjusting method for an on-demand multi-nozzle ink jet head including a plurality of ink chambers filling ink therein, said plurality of ink chambers being defined by a nozzle plate formed with a plurality of nozzles in one-to-one correspondence with said plurality of ink chambers, and a plurality of piezoelectric elements provided in one-to-one correspondence with said plurality of ink chambers, each of said plurality of piezoelectric elements being deformed when a drive pulse is applied thereto, thereby varying pressure in a corresponding ink chamber and ejecting an ink droplet from a corresponding nozzle, the method comprising the steps of:

(a) applying a drive pulse to all piezoelectric elements selected from said plurality of piezoelectric elements to eject ink droplets from corresponding nozzles; and (b) individually adjusting the drive pulse applied to the selected piezoelectric elements such that the drive pulse is set differently for the selected piezoelectric elements so that said corresponding nozzles eject ink droplets at the same speed when said corresponding nozzles are driven simultaneously.

* * * * *